United States Patent [19]

Suzuki et al.

[11] 4,445,009

[45] Apr. 24, 1984

[54] STEP SWITCH

[75] Inventors: Masaru Suzuki; Akira Ogawa, both of Aichi, Japan

[73] Assignee: Kabushiki Kaisha Tokai Rika Denki Seisakusho, Aichi, Japan

[21] Appl. No.: 313,082

[22] Filed: Oct. 20, 1981

[30] Foreign Application Priority Data

Oct. 20, 1980 [JP] Japan ..... 55-146593
Oct. 20, 1980 [JP] Japan ..... 55-149464[U]

[51] Int. Cl.[3] ..... H01H 9/00; H01H 15/00

[52] U.S. Cl. ..... 200/5 R; 200/16 C; 200/17 R

[58] Field of Search ..... 200/5 R, 5 E, 50 C, 200/16 C, 17 R, 18

[56] References Cited

U.S. PATENT DOCUMENTS 3,889,075 6/1975 Morrell et al. ..... 200/5 E
4,126,153 11/1978 Raab ..... 200/16 C X
4,143,252 3/1979 Moore ..... 200/5 E X

*Primary Examiner*—J. R. Scott
*Attorney, Agent, or Firm*—Sughrue, Mion, Zinn, Macpeak & Seas

[57] ABSTRACT

A step switch is formed by a rocking member which is coupled at its ends to perpendicular pivotting interlocking levers which, in turn, reciprocate a control plate in a longitudinal direction. The control plate carries pawls which engage ratchet teeth on a slidable contact holder to move the latter through one step in response to pressure on either end of the rocking member. A notch is formed for receiving each pawl at the end of its reciprocating path for preventing slip in the switch operation.

10 Claims, 9 Drawing Figures

STEP SWITCH

BACKGROUND OF THE INVENTION

This invention is directed to a step switch in which, as a rocking member is rocked in a desired direction, a stepping contact holder is stepped in the required direction, to open or close a plurality of circuits.

This invention is further related to such a switch in which the switching steps can be positively and reliably achieved.

SUMMARY OF THE INVENTION

In the step switch according to this invention, a pair of interlocking levers are always operated in association with the manual forcible operation and automatic restoring operation of a rocking member which is rockably supported on a switch body through a central portion, a stepping control plate is linearly reciprocated with a predetermined stroke, with both longitudinal ends thereof coupled to the pair of interlocking levers, and feed pawls protruded symmetrically from the two longitudinal ends of the stepping control plate are engaged with saw-teeth arrays having engaging surfaces arranged symmetrically on both longitudinal end portions of a stepping contact holder, so that the stepping contact holder is stepped in a desired direction by depressing a part of the rocking member, which depressed part is displaced from the axis of the rocking member.

BRIEF DESCRIPTION OF THE DRAWINGS

One preferred embodiment of this invention will be described with reference to the accompanying drawings, in which:

FIG. 3 is a side view of the step switch, which will be a front view thereof when the step switch is mounted on a machine or the like;

DETAILED DESCRIPTION OF THE INVENTION

Figure 1:
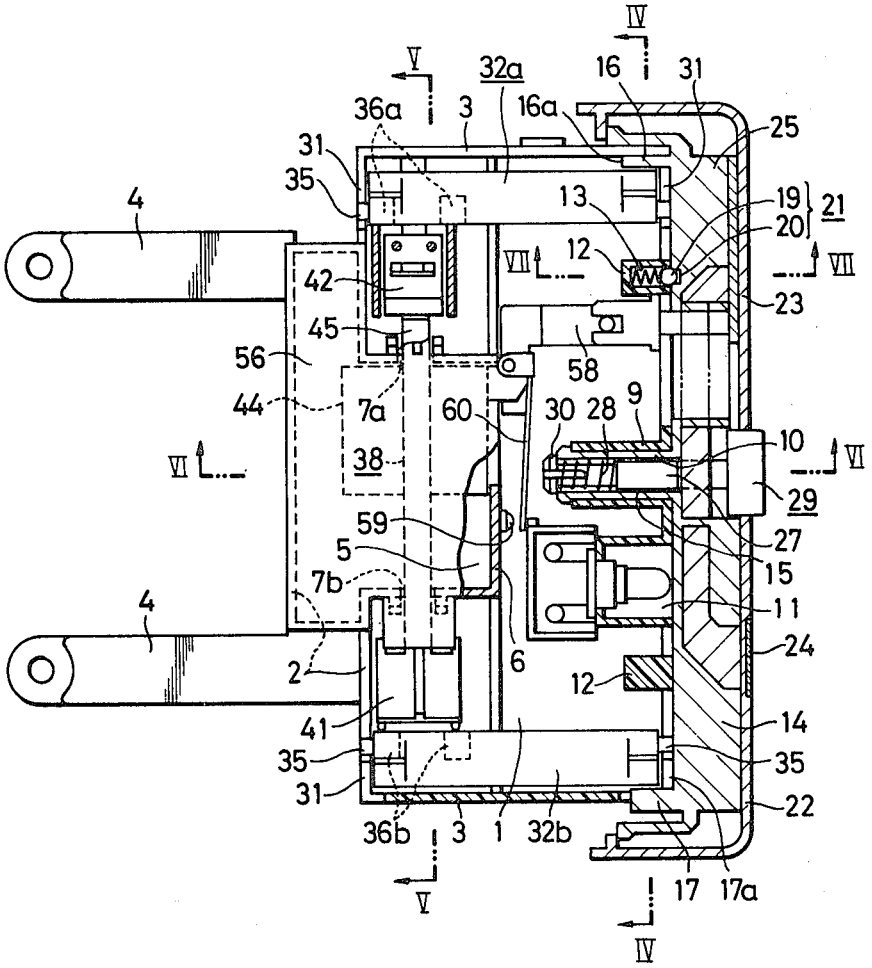
FIG. 1 is a front view, with parts cut away, of the step switch.
Figure 2:
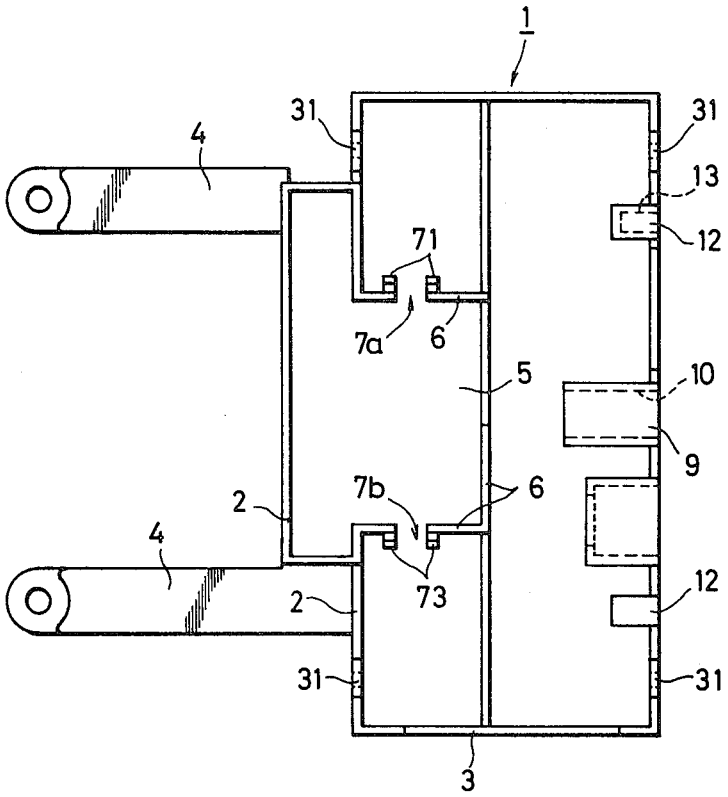
FIG. 2 is a front view of the body 1 of FIG. 1.
Figure 5:
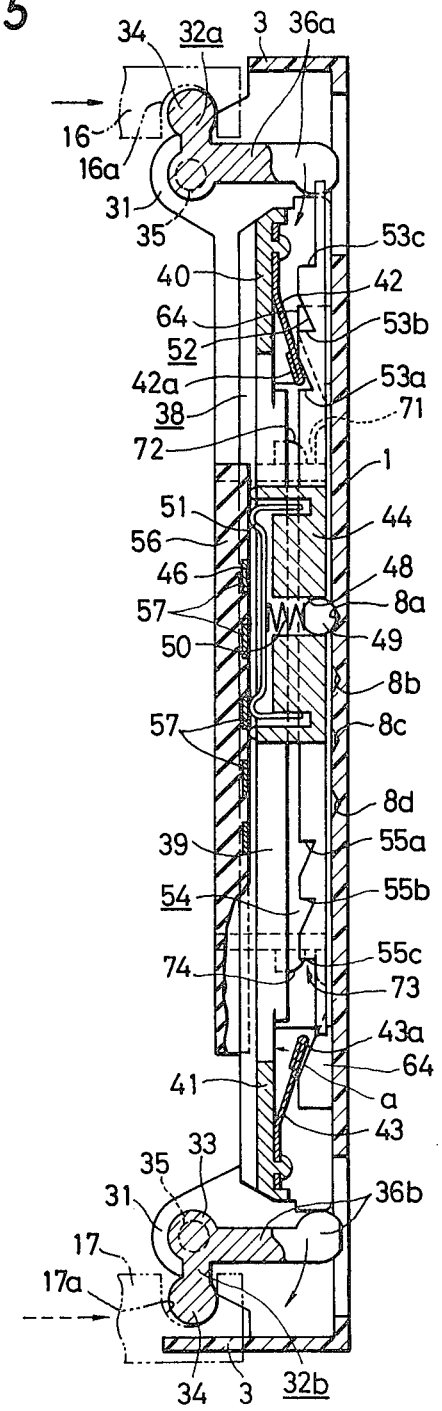
FIG. 5 is a sectional enlarged side view taken along line V—V in FIG. 1.

In the drawings, reference numeral 1 designates a body of synthetic resin. The body 1 is substantially rectangular and relatively small in thickness. Three end portions of the body, other than the front end portion on the right-hand side of FIGS. 1 or 2, are provided with low upright walls 2, 3 and 3, respectively. Mounting legs 4 and 4 are extended from the wall 2 of the rear end portion of the body. A contact holder sliding region 5 is provided on the upper surface of the body and near the rear end. More specifically, the sliding region 5 is surrounded by a low upright wall 6 and the aforementioned wall 2. The upright wall 6 has sliding cuts 7*a* and 7*b* which are located above and below in FIGS. 1 or 2 and are arranged in a line. Several stepping recesses 8*a*, 8*b*, 8*c* and 8*d* are formed at intervals of a stepping distance in the bottom of the sliding region 5 (or a plate placed on the bottom as shown in FIG. 5). A supporting protrusion 9 having a hole 10 at its center (as viewed vertically in FIG. 1 or 2), a lamp house 11 adjacent to the supporting protrusion 9, and guide protrusion 12 and 12 equidistant from the supporting protrusion 9 are provided at the front end portion of the body. A blind hole 13 which is open to the outside is formed in one of the protrusions 12.

Figure 4:
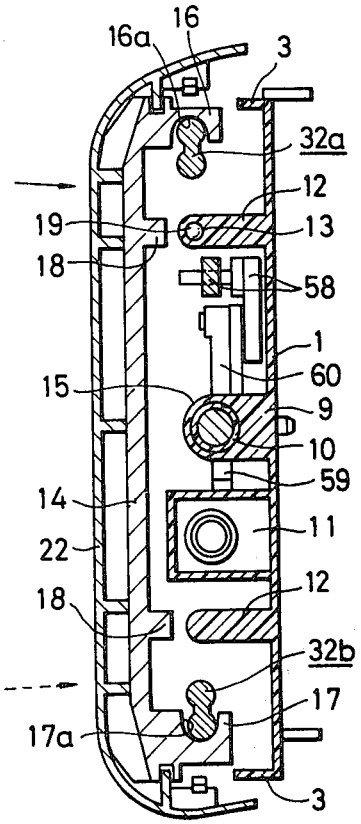
FIG. 4 is a sectional side view taken along line IV—IV in FIG. 1.
Figure 7:
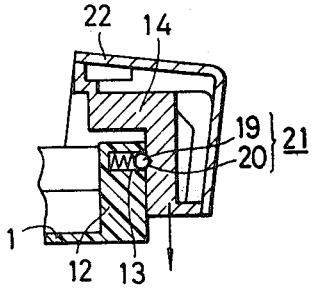
FIG. 7 is a sectional view taken along line VII—VII in FIG. 1.

Reference numeral 14 designates a rocking member which is rockably supported on the body 1 via a tubular shaft 15 inserted into the central hole 10 of the supporting protrusion 9, with the tubular shaft 15 extending from the center of the member 14. The member 14 is so designed that it can rock, with the outer end surfaces of the supporting protrusion 9, the lamp house 11 and the guide protrusions 12 as guides. As shown in FIG. 4, the rocker 14 has engaging protrusions 16 and 17 at the upper and lower ends, respectively, and these engaging protrusions 16 and 17 have semicircular engaging recesses 16*a* and 17*a*, respectively. Rocking range regulating pieces 18 and 18 protrude from the rocker 14 in such a manner that they confront the sides of the guide protrusions 12 and 12, respectively. A ball 19 and a spring are inserted into the blind hole 13 in such a manner that the ball 19 is urged outwardly by the spring. A V-shaped engaging groove 20 is provided in the direction of rocking of the rocker 14, as shown in FIG. 7. The ball 19 is engaged with the V-shaped engaging groove 20, to form one example of a rocking restoring means 21 according to this invention.

A cover 22 is closely fitted over the rocker 14. A part of the cover 22, which is spaced apart from the tubular shaft 15, can be pushed as indicated by either the solid line arrow or the dotted line arrow in FIGS. 3 through 5, so that the cover 22 rocks together with the rocking member 14. Display windows 23 and 24 are provided respectively in the upper portion and the lower portion of the side of the cover 22, which will face forward when the body 1 is mounted on a machine or the like. A movable plate 25 having symbols 26 representative of stepping pitches is provided on the rear side of the display window 23.

Figure 3:
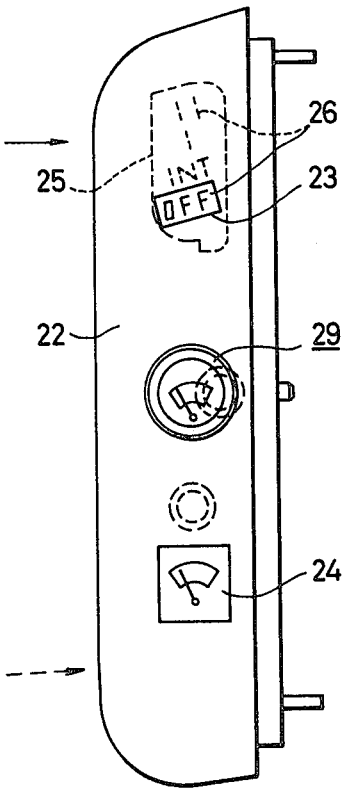
Figure 6:
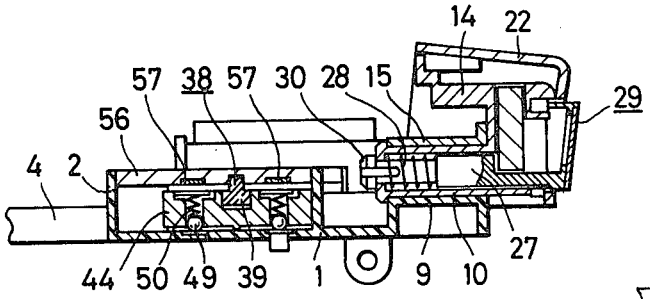
FIG. 6 is a sectional view taken along line VI—VI in FIG. 1.

A returning spring 28 is engaged with the end of a short pipe 27, to form a push button 29. As shown most clearly in FIG. 6, the expanding end 30 of the push button shaft 27 is inserted through the center of the tubular shaft portion 15 of the rocking member 14 in such a manner that the push button 29 appears as shown in FIG. 3 and the short pipe 27 is in contact with the inner surface of the rocking member 14.

Figure 8:
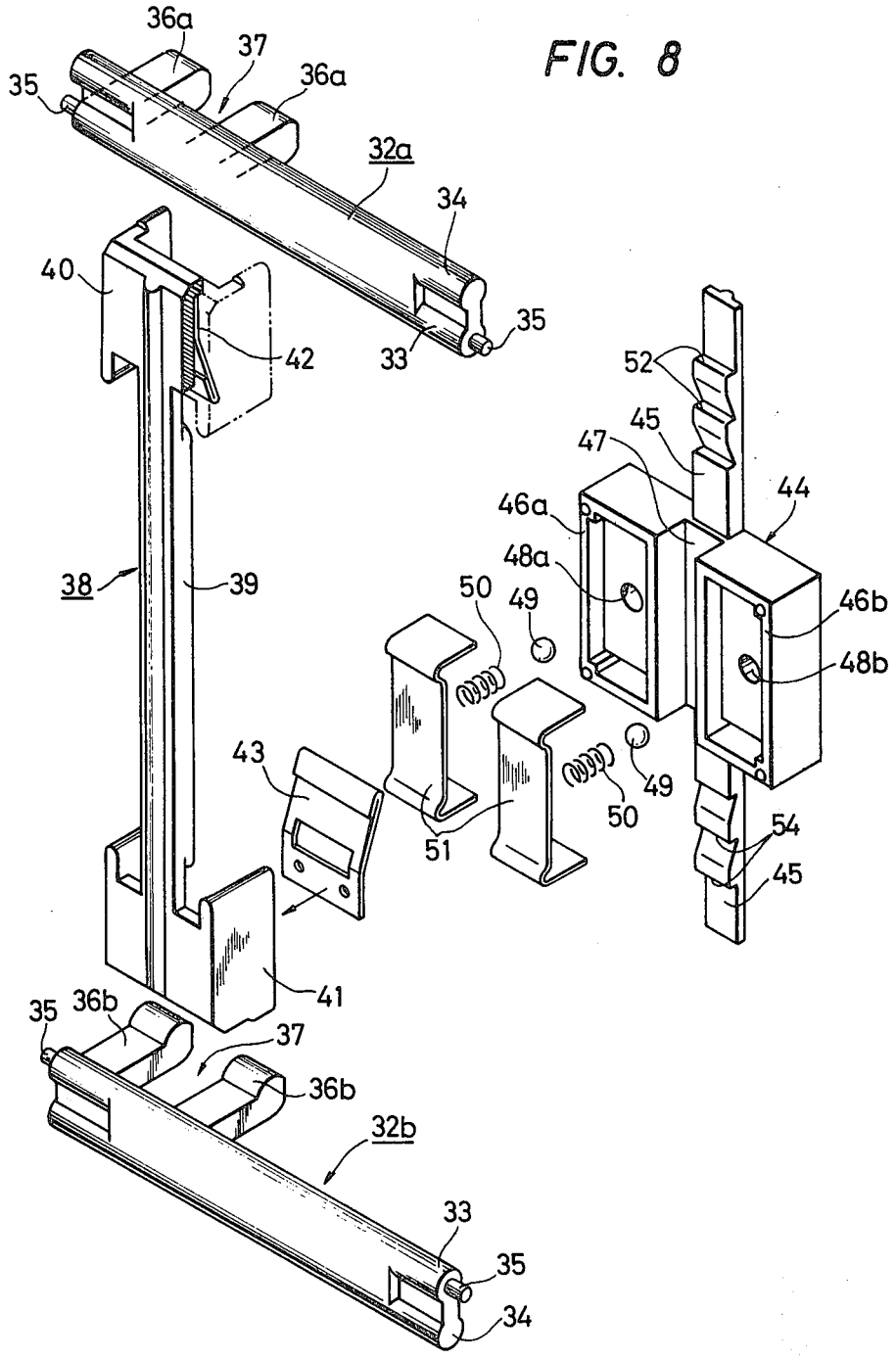
FIG. 8 is an exploded perspective view showing some components of the step switch.

A pair of supporting pieces 31 protrude from the front edge portion and the upright wall 2 of the body 1, as shown in FIG. 5, and a pair of interlocking levers 32*a* and 32*b* each having both end portions curved are also provided. As shown in FIGS. 1 and 8, shafts 35 protruding from first curved portions 33 of the interlocking levers 32*a* and 32*b* are supported by the pair of supporting pieces 31. The other curved portions 34 are loosely fitted in the engaging recesses 16*a* and 17*a* of the engaging protrusions 16 and 17, respectively, so that the interlocking levers 32*a* and 32*b* are engaged with the upper and lower ends of the rocking member 14. Fork-shaped engaging protrusions 36*a* and 36*b* (FIGS. 1, 8) protrude perpendicularly from the interlocking levers near the upright wall 2 of the body 1, and each of the fork-shaped engaging protrusions has a groove 37 in its center. The grooves 37 correspond to the upper and lower sliding cuts 7*a* and 7*b*, respectively, of the upright wall 6.

Reference numeral 38 designates a stepping control plate. The stepping control plate 38 comprises a relatively thin rod 39 which is extended into the sliding region 5 from the sliding cuts 7*a* and 7*b*, and relatively large engaging parts 40 and 41 each of which is in the form of an inverted box having the upper and lower sides removed. The engaging parts 40 and 41 are provided at the upper and lower ends of the rod 39, respectively. The engaging parts 40 and 41, which are in contact with the surface of the body 1, are held between the engaging protrusions 36*a* and 36*b* of the interlocking levers 32*a* and 32*b*, respectively. A pair of feed pawls 42 and 43 are symmetrically mounted on the lower surfaces of the engaging parts 40 and 41, respectively. More specifically, the feed pawls 42 and 43 are moderately inclined ones which are made of a leaf spring, and the feed pawls 42 and 43 are mounted on the engaging parts 40 and 41 in such a manner that their ends are protruded towards each other as shown in FIGS. 5 and 8.

Reference numeral 44 designates a stepping contact holder. Contact mounting boxes 46*a* and 46*b* are protruded from both sides of the central portion of a thin rod 45 which is extended vertically through the sliding cuts 7*a* and 7*b* of the upright wall 6. A groove 47 is formed between the boxes 46*a* and 46*b*. Through-holes 48*a* and 48*b* are cut in the bottoms of the boxes 46*a* and 46*b*, and an engaging ball 49 and a part of spring 50 are inserted into each of the through-holes 48*a* and 48*b*. Contacts 51 and 51 are set on the boxes 46*a* and 46*b*, respectively, and the springs 50 and 50 are brought into contact with the lower surfaces of the contacts 51 and 51, to provide contact pressures. Furthermore, two arrays of saw-teeth 52 and 54 which have engaging surfaces 53*a*, 53*b* and 53*c* and engaging surfaces 55*a*, 55*b* and 55*c* arranged at stepping pitch intervals, are formed on portions of the thin rod 45 which extend upwardly and downwardly. In this embodiment, no saw-teeth are formed on the upper and lower end portions of the rod 45; that is, the upper and lower end portions remain flat, so that, for instance, when the stepping contact holder 44 is moved to its top position as shown in FIG. 5, the feed pawl 42 engages the lowest engaging surface 53*a*, while the other feed pawl 43 is set a distance corresponding to one stepping pitch below the lowest engaging surface 55*c*. The thin rod 45 is so designed that it can be inserted into the grooves 37 of the interlocking levers 32*a* and 32*b*.

The engaging ball 49 can engage with any of the aforementioned stepping recesses 8*a* thorugh 8*d* as shown in FIG. 5. When the feed pawl 42 contacts the engaging surface 53*a* as shown in FIG. 5, the engaging ball 49 engages with the stepping recess 8*a*.

An insulating plate 56 is fixedly placed on the upper surface of the sliding region 5. An array of fixed contacts 57 are provided on the lower surface of the insulating plate 56 in such a manner that they are brought into contact with the contacts 51 successively as the latter move vertically as viewed in FIG. 5. FIG. 5 shows an "off" state. An arm 58 (FIGS. 1 and 4) extended from the stepping contact holder 44 through a sliding hole (not shown) cut in the upright wall 6 is coupled to the movable plate 25, to step the movable plate 25.

A stationary contact 59 and a movable contact 60 made of a leaf spring are provided on the upright wall 6 in such a manner that, when the movable contact 60 is pushed by the shaft 30 of the push button 29, the movable contact 60 is brought into contact with the stationary contact 59.

When the end of the rocking member 14 located above the tubular shaft 15 is pushed as indicated by the solid line arrow, then the upper interlocking lever 32 coupled through the engaging recess 16*a* of the engaging protrusion 16 is pivotted about the shaft 35 in the direction of the arrow, while the engaging protrusion 17 is moved in a direction opposite to the direction of the dotted line arrow, and therefore the lower interlocking lever 32 coupled through the engaging recess 17*a* is pivotted about the shaft 35 in the direction of the solid curved arrow 80 shown at the bottom of FIG. 5. As a result, the stepping control plate 38 is moved downwardly by the engaging protrusion 36 of the upper interlocking lever 32, so that the feed pawl 42 pushes the engaging surface 53*a* to move the stepping contact holder 44 downwardly by one pitch. At this time, the spring pawl 43 rides up on a camming surface 64, formed on the body 1, to allow the sawtooth array 54 to slide thereunder. Simultaneously, the engaging ball 49 is displaced to the stepping recess 8*b*. By the above-described rocking motion, the ball 19 slides onto the right-hand sloped surface of the V-shaped engaging groove 20, so that the rocking member 14 is biased for restoration. Therefore, as soon as the rocking member 14 is released, the ball 19 moves left to the deepest position in the V-shaped engaging groove 20, as a result of which the rocking member 14 is automatically restored to the neutral position as shown in FIG. 4.

In the above-described embodiment, the stepping contact holder 44 can move three steps from center both upwardly and downwardly. The stepping contact holder 44 which has been stepped upwardly can be stepped downwardly, and vice versa.

In the above-described embodiment, when the stepping contact holder 44 is at the stepping position as shown in FIG. 5, the feed pawl 43 is spaced a distance corresponding to one stepping pitch apart from the engaging surface 55*c*. Therefore, even when the part of the rocking member 14, which is located below the tubular shaft 15, is pushed as indicated by the dotted line arrow to cause the engaging protrusion 36 of the lower interlocking lever 32 to push the stepping control the plate 38 upwardly, the feed pawl 43 cannot reach the stepping contact holder 44; that is, the holder 44 is maintained in its present position and no damage to the stepping mechanism results.

As is apparent from the above-description, the step switch according to the invention comprises the rocking number; one pair of interlocking levers coupling the control plate to the rocking member; the stepping control plate reciprocating linearly with a predetermined stroke between the interlocking levers; one pair of feed pawls which protruded from either end of the control plate; and the stepping contact holder having the engaging surfaces arranged symmetrically on both end portions, the engaging surfaces being pushed by one of the feed pawls to step the holder one predetermined pitch at a time, so that the step switch is stepped in both directions to be turned on and off with high accuracy. Thus, the step switch according to the invention is excellent in performance.

In the step switch according to this invention, the elastic feed pawls 42 and 43 are extended on both sides of the saw-teeth arrays 52 and 54, respectively, i.e., the pawls are wider than the saw-teeth. Therefore, introducing grooves 71 and 73 which have guide surfaces 72 and 74 for the elastic feed pawls 42 and 43 at the inlets, respectively, are provided at positions on either side of the stepping control plate 38. The ends 42*a* and 43*a* of the elastic feed pawls 42 ad 43 are moved into these grooves with reciprocation of the stepping control plate 28; i.e. above the sliding cut 7*a* and below the sliding cut 7*b* in the above-described embodiment, respectively.

Figure 9:
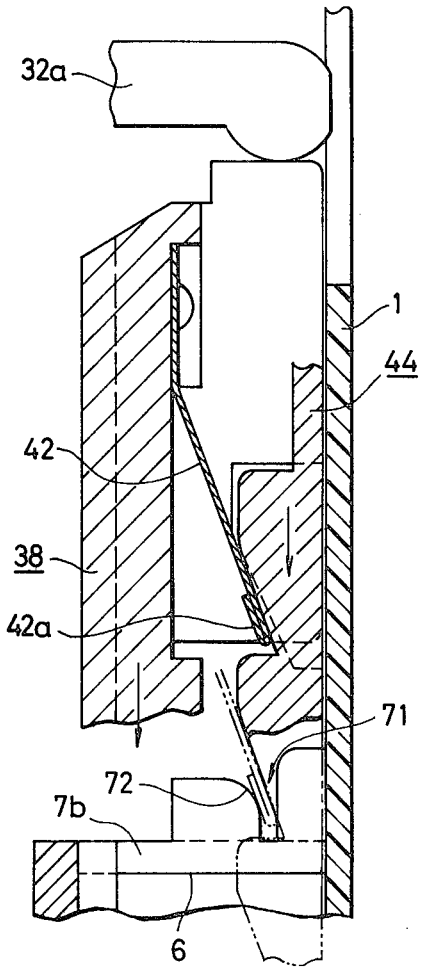
FIG. 9 is a sectional enlarged side view showing essential components of the step switch anti-jumping feature.

FIG. 9 is an enlarged diagram showing the introducing groove 71 and its guide surface 72, which are symetrical with the other introducing groove 73 and its guide surface 74.

When the rocking member 14 is depressed quickly in the direction of the solid line arrow in FIG. 3 so that the stepping control plate 38 is abruptly moved downwardly in FIG. 5, then the elastic feed pawl 43 is swung in the direction of the arrow a by the cam member 64, while the elastic feed pawl 42 pushes one of the engaging surfaces 53*a* through 53*c*, as a result of which the stepping contact holder 44 is moved at high speed in the direction of movement of the stepping control plate 38. In this case, even when the stepping control plate 38 has been moved for the predetermined distance, the elastic feed pawl 43 swung in the direction of the arrow a is not always restored immediately. Accordingly, the stepping contact holder 44, moving at high speed, may cause an extra one of the engaging surfaces 55*a* through 55*c* to slide under the elastic feed pawl 43 while simultaneously allowing the elastic feed pawl 42 to click backward along the saw-teeth array 52. That is, in this case, the stepping contact holder 44 is moved farther than a distance corresponding to one step; i.e. it is caused to jump. Because of this jump phenomenon, the operation (opening and closing) of the contacts becomes unstable. When the stepping control plate 38 is moved quickly upwardly, the jump phenomenon may also occur in the opposite direction. This trouble cannot be overcome with locking means consisting of the engaging balls 49 and the engaging recesses 8*a* through 8*d*.

However, this trouble is eliminated according to a further feature of this invention. As was described before, the elastic feed pawls 42 and 43 which are inclined symmetrically with each other extend on either side of the saw-teeth arrays 52 and 54 of the stepping contact holder 44, and the introducing grooves 71 and 73 are provided at the positions to which the ends 42*a* and 43*a* of the elastic feed pawls 42 and 43 are moved. Therefore, when the stepping control plate 38 and the stepping contact holder 44 are moved in the same direction and the stepping control plate 38 is moved the predetermined distance, the end 42*a* (or 43*a*) of the elastic feed pawl 42 (or 43) is locked by the introducing groove 71 (or 73) as indicated by the two-dot chain line in FIG. 9. As a result, the saw-teeth array 52 (or 54) of the stepping contact holder 44 in inertial motion is braked, i.e. the pawl is prevented from clicking over the saw-teeth. Thus, the contact holder 44 is never caused to jump and after moving the distance corresponding to one stepping pitch, the contact holder 44 is stopped.

As is apparent from the above description, according to this invention, simple means are provided at two positions to which the stepping control plate 38 is moved, so that, when the stepping contact holder 44 is moved quickly, the elastic feed pawls 42 and 43 are prevented from being swung and the stepping contact holder 44 is braked at the desired position. Thus, jumping of the stepping contact holder 44 is substantially positively prevented.

What is claimed is:

1. A step switch comprising:

a body;

a rocking member pivotably mounted at a control portion thereof to said body, said rocking member being pivotable in either direction about a neutral position and about a pivoting axis located at a central portion thereof, said pivoting axis being substantially perpendicular to a longitudinal direction of said rocking member;

biasing means for biasing said rocking member towards its neutral position;

a pair of interlocking levers coupled to either end of said rocking member and mounted for pivotal movement with pivoting of said rocking memeber, said interlocking levers in their neutral positions being substantially perpendicular to said rocking member whereby free ends of said interlocking levers will move in a direction toward and away from said rocking member central portion;

a stepping control plate having either end coupled to said free ends of said interlocking levers;

means for moving said stepping control plate along the longitudinal direction of said rocking member and reciprocating said stepping control plate in a predetermined stroke in the longitudinal direction by said free ends in response to pivoting movement of said rocking member and in response to the return of said rocking member to its neutral position by said biasing means;

a pair of feed pawls at either end of said stepping control plate;

a slidable contact holder engaged by said pawls for movement in the longitudinal direction of said rocking member during pivoting of said rocking member from its neutral position but remaining substantially stationary during pivoting movement of said rocking member towards its neutral position; and electrical switching means selectively actuated in accordance with the longitudinal position of said contact holder.

2. A step switch as claimed in claim 1, wherein said contact holder includes first and second sets of ratchet teeth engageable by a respective one of said pawls, one of said pawls positively engaging said first set when moving in a first direction and sliding over said first set when moving in an opposite direction, and the other of said pawls positively engaging said second set when moving in said opposite direction and sliding over said second set when moving in said first direction.

3. A step switch as claimed in claim 2, wherein said pawls are disposed on opposite sides of said central portion of said rocking member and each of said pawls positively engages its respective ratchet tooth set when moving toward said central portion.

4. A step switch as claimed in claim 1, wherein said rocking member and interlocking levers pivot about substantially parallel axes.

5. A step switch as claimed in claim 1, further comprising means for limiting the range of pivoting movement of said rocking member.

6. A step switch as claimed in claim 1, wherein each of said interlocking levers includes a coupling portion extending from its pivot axis in a direction different from said free end, said coupling portions being coupled to the ends of said stepping control plate.

7. A step switch as claimed in claim 1, further comprising a plurality of indentations on said body and second biasing means located on said contact holder for engaging said indentations to maintain said contact holder in one of a plurality of discrete positions.

8. A step switch as claimed in claim 2, further comprising non-slip means for preventing said one pawl from sliding over said set of ratchet teeth when said one pawl has moved substantially to the end of said predetermined stroke in said one direction, and for preventing said second pawl from sliding over said second set of ratchet teeth when said second pawl has moved substantially to the end of said predetermined stroke in said opposite direction.

9. A step switch as claimed in claim 8, wherein said non-slip means comprises a notch (72) formed in a portion of said body adjacent the end of the reciprocating path of each pawl, said notch abutting against its respective pawl to prevent movement of said pawl away from said ratchet teeth.

10. A step switch as claimed in claim 1, wherein said electrical switching means comprises an insulating plate, a plurality of electrical contact members mounted on said insulating plate, and at least one movable contact carried on said contact holder and selectively engageable with said electrical contact members.

* * * * *